US006383089B1

(12) United States Patent
Bonneau

(10) Patent No.: US 6,383,089 B1
(45) Date of Patent: May 7, 2002

(54) INVERTED MASS RELIEVED PUTTER

(76) Inventor: Michael D. Bonneau, 5831 Algonquin Way, San Jose, CA (US) 95138

( * ) Notice: Subject to any disclaimer, the term of this patent is extended or adjusted under 35 U.S.C. 154(b) by 0 days.

(21) Appl. No.: 09/557,186

(22) Filed: Apr. 21, 2000

(51) Int. Cl.[7] ..... A63B 53/04

(52) U.S. Cl. ..... 473/313; 473/335; 473/340; 473/341; 473/342

(58) Field of Search ..... D21/736, 741; 473/324, 330, 340, 341, 313, 349, 256, 333, 334, 335, 336, 337, 338, 339, 342

(56) References Cited

U.S. PATENT DOCUMENTS

| | | | | |
|---|---|---|---|---|
| RE19,178 | E | * | 5/1934 | Spiker |
| D95,819 | S | * | 6/1935 | Gourlay |
| D239,402 | S | * | 3/1976 | Kindred |
| D248,783 | S | * | 8/1978 | Long |
| 4,650,191 | A | * | 3/1987 | Mills |
| 4,795,157 | A | * | 1/1989 | Bencriscutto |
| 4,824,115 | A | * | 4/1989 | Walther |
| 4,999,000 | A | * | 3/1991 | Finney |
| D328,116 | S | * | 7/1992 | Antonious |
| D329,266 | S | * | 9/1992 | Antonious |
| 5,211,401 | A | * | 5/1993 | Hainey |
| 5,246,231 | A | * | 9/1993 | Antonious |
| 5,248,145 | A | * | 9/1993 | Brown |
| 5,344,149 | A | * | 9/1994 | Miller |
| 5,464,215 | A | * | 11/1995 | Koehler |
| 5,489,097 | A | | 2/1996 | Simmons |
| 5,494,288 | A | | 2/1996 | Jimenez et al. |
| 5,624,329 | A | * | 4/1997 | Schneebeli |
| 5,655,976 | A | * | 8/1997 | Rife |
| 5,782,705 | A | | 7/1998 | Solari |
| 5,782,706 | A | | 7/1998 | DePriest |
| 5,797,176 | A | | 8/1998 | Rose et al. |
| 5,803,825 | A | | 9/1998 | Hamilton |
| 5,816,930 | A | | 10/1998 | Brown |
| 5,827,130 | A | | 10/1998 | Jimenez et al. |
| 5,857,922 | A | | 1/1999 | Delio |
| 5,871,407 | A | | 2/1999 | Tseng |
| 6,019,686 | A | * | 2/2000 | Gray |

* cited by examiner

*Primary Examiner*—Sebastiano Passaniti
(74) *Attorney, Agent, or Firm*—Thomas Schneck

(57) ABSTRACT

A putter head fashioned from a block metal having a conventional face, but having a mass relieved portion behind the face, with greatest mass relief at the sole of the club and a lesser amount of mass relief extending upwardly to the top surface of the club which has conventional dimensions and shape. Since the greatest amount of mass relief is at the bottom of the club, the mass relief is said to be inverted. A pair of inclined ribs behind the central portion of the face add stiffness to the club. The club has a raised center of gravity intended to be in alignment with the center of a golf ball. A plug of heavy metal may be centered on the center of gravity to add stiffness at the zone. Although the club would typically be made out of aluminum or steel, a club, without the plug, could be made of an ultra heavy metal, such as depleted uranium, and be no heavier than a regular club due to the inverted mass relief.

20 Claims, 5 Drawing Sheets

INVERTED MASS RELIEVED PUTTER

TECHNICAL FIELD

The invention relates to golf clubs and, in particular, to putters.

BACKGROUND ART

Putters are generally manufactured with upright faces so that the club will strike the ball squarely propelling the ball on the ground a short distance. In this regard, the putter is different from other clubs which seek to achieve varying degrees of loft if at all, causing the ball to fly varying amounts of distance. To the contrary, a putter should be designed so that the ball cam be accurately propelled shot distances of a few feet, or longer distances of several yards and so the ball will only slightly fly, or not at all.

In the prior art, there are many mass relieved putters, most having mass relieved in the upper portion of the putter, leaving a putter which is bottom heavy. An example is U.S. Pat. No. 5,857,922 to R. Delio. The '922 patent shows a square club face, with mass relief, intended to produce negative loft. Mass relief is in the center of the club, directly behind the face leaving the heel and toe portion of the club undisturbed. The center of gravity of the club head is intended to be above the center line of the ball, imparting overspin on the ball which keeps the ball in contact with the ground.

U.S. Pat. No. 5,494,288 to R. Jimenez et al., a golf putter is disclosed having similar mass relief and once again, heel and toe regions are maintained with the standard amount of mass. The club shaft is brought into contact with the sole of the club. This design is said to eliminate Dutter face twist when the ball is struck.

A large number of other patents have various mass relief features, for various purposes, but all producing a club which has a substantial sole or bottom surface. A problem with a heavy sole of the putter is that the center of gravity of the club lies below the center of the ball when the ball is struck. This tends to produce backspin, sometimes with loft, with an unpredictable result. An object of the invention was to devise a putter which has limited and controlled loft, resists twisting and generally presents a higher center of gravity for solid force transmission toward the center of a golf ball.

SUMMARY OF THE INVENTION

The above object has been achieved with a new putter design, with mass relief which increases the height of the center of gravity of the club. Over reasonably short distances, the best place to transmit force to a golf ball is at a point in alignment with the center of the ball. The club of the present invention reduces the size of the sole of the club to only a few millimeters while the top surface of the club remains the same. The mass relieved region of the club is immediately behind the face and below the top surface between the heel and toe regions. The club is fabricated from a block of metal, with mass relief achieved by milling regions behind the face of the club and below the top surface. Because most of the club head mass is removed at the bottom of the head, the club design has inverted mass relief compared to clubs of the prior art where mass relief was mainly at the top of the head. Some mass is left at the heel and toe regions so that these formed balaced regions, keeping the club from twisting. A pair of ribs is left immediately behind the face for strength and definition of a sweet spot between the ribs. A hosel arm makes contact with the top surface of the club above the sweet spot so that the club can squarely address a golf ball with ease of alignment. The sweet spot of the club may be stiffened with the addition of a plug of a heavy metal, such as depleted uranium. This quickens the ball release upon impact, yet the weight of the club is comparable to ordinary clubs.

DESCRIPTION OF THE INVENTION

Figure 1:
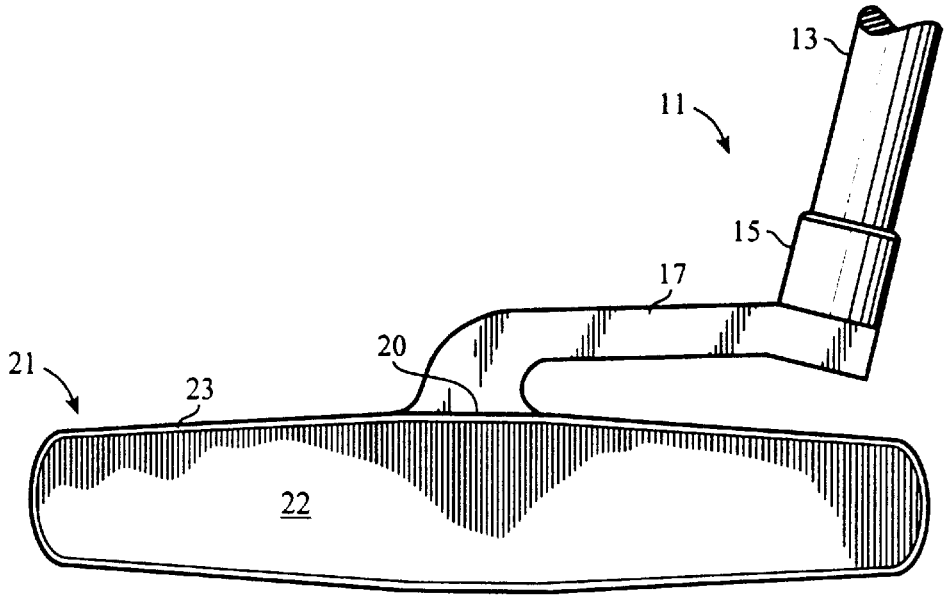
FIG. 1 is a front elevational view of the inverted mass relieved putter head of the present invention.

With reference to FIG. 1, the putter head 11 is connected to an elongated shaft 13 which may be gripped by a golfer. The shaft 13 is secured in a hosel 15, serving as a socket for the shaft 13. The hosel is part of a hosel arm 17 which is secured to the upper surface 23 of the club head 21. The hosel arm is secured at a junction 20 which may be over the central region of a club or may be at an end of a club, depending upon the preference of the golfer. Club face 22 addresses a golf ball, not shown.

Figure 2:
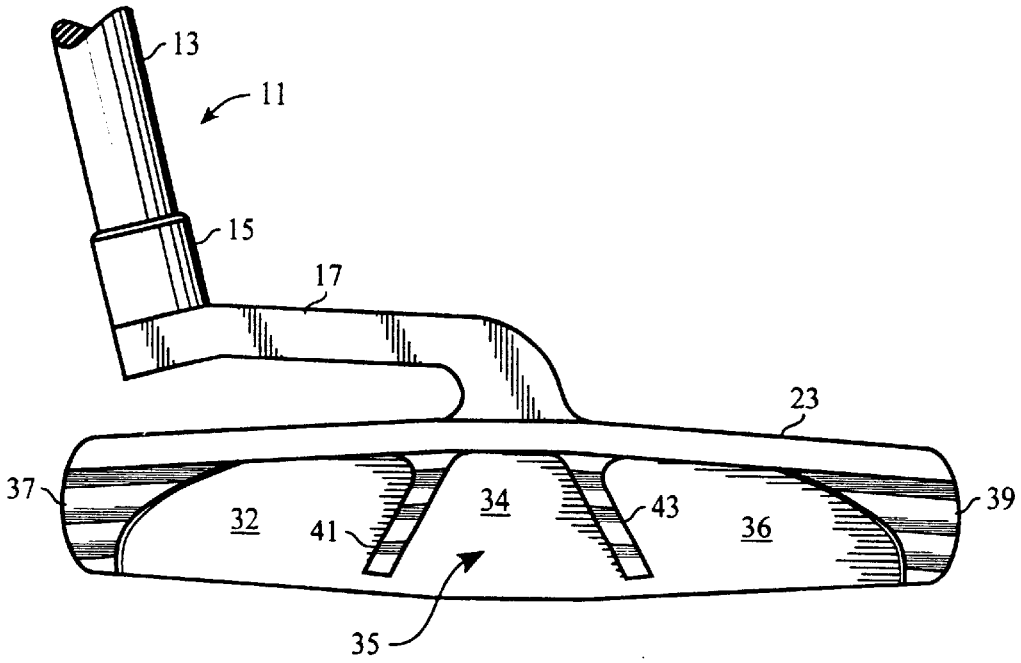
FIG. 2 is a back elevational view of the apparatus of FIG. 1.

Shown for the first time in FIG. 2 is the mass relieved area 35 beneath the top surface 23 of the club head and behind the club face 22. The ribs 41 and 43 depend downwardly at angles from the top surface 23 and divide the mass relieved region into a left side region 32, a central region 34 and a right side region 36. The side regions 32 and 36 are approximately of equal size. The ribs 41 and 43 serve to make the club face stiff and add to the overall strength of the club. Heel region 37 and toe region 39 have a lesser amount of mass relief than the left and right side regions.

Figure 3:
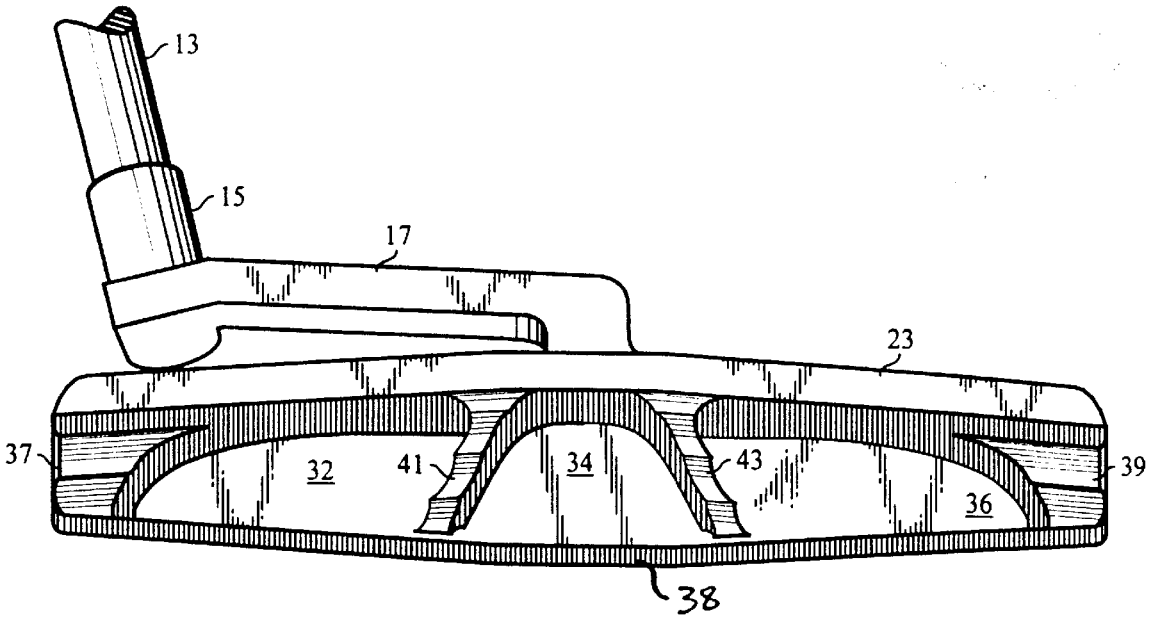
FIG. 3 is a back tilted view of the apparatus shown in FIG. 2.

In FIG. 3, the club has been tilted forwardly, revealing the three dimensional contours of the mass relieved region. It will be seen that the ribs 41 and 43 are stepped, as well as the heel region 37 and the toe region 39. It should be noted that the mass relief does not extend all the way to the edges of the club, but leaves a significant amount of mass at the heel and toe regions 37 and 39. Added mass at the extremities of the club head add inertia against twisting forces. It will be seen that the sole 38 at the bottom of the club is quite thin, unlike the top surface 23 which is indistinguishable from the top surface of any putter. On the other hand, the sole 38 is only a few millimeters thick, with the back surface of the sole being parallel to the front surface or face of the club. Mass behind this back surface is removed upwardly to within a few millimeters of the top surface of the club in the three regions previously described. The effect of removing mass is to raise the center of gravity of the club. This allows the center of gravity of the club to be more inline with the center of a golf ball in order to avoid significant lofting on medium to long range putts. The mass relief is created by milling an aluminum block but could also be made by casting or molding.

Figure 4:
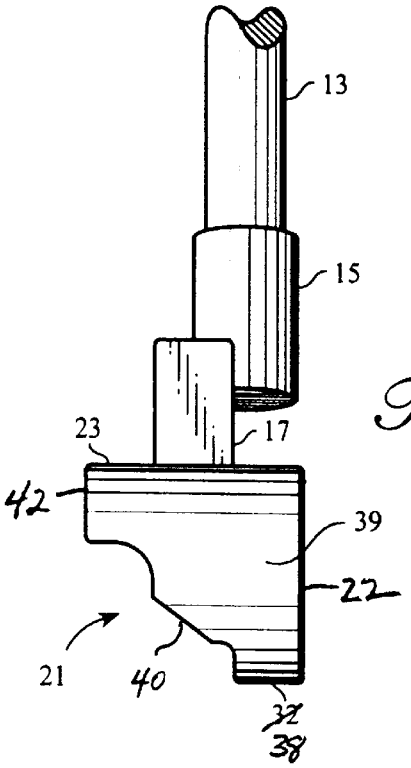
FIG. 4 is a left side view of the apparatus of FIG. 1.
Figure 5A:
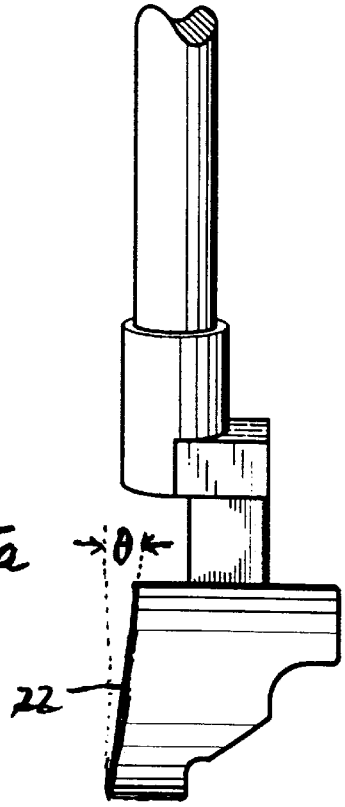
FIG. 5*a* is a right side view of a modified club of the present invention with a club face slightly inclined from vertical.
Figure 5:
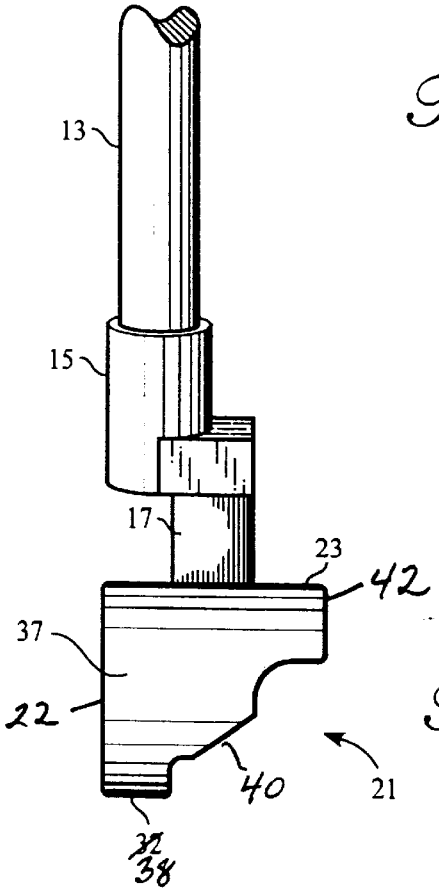
FIG. 5 is a right side view of the apparatus of FIG. 1.

With reference to FIGS. 4 and 5, the thickness of the sole 32 may be seen in proportion to the overall thickness of the club. Also, the stepped nature of the heel 37 and toe 39 may be seen. The club head 21 is connected to shaft 13 by the hosel arm 17, supporting hosel 15. It will be seen that the hosel arm 17 joins the top surface 23 at approximately the center of its thickness, with the shaft 13 being over the sole 32 so that the hosel 15 serves as a visual alignment site relative to the ball. The contour of the mass relief for both the heel 37 and toe 39 may be seen. The profiles are identical and may be characterized as stepped, but the profile is triangular. The club head profile is a block metal with top surface 23 having generally rectangular edges. The front face 22 extends from a forward edge of the top surface to the sole 38. The hypotenuse 40 of the triangular cross section joins sole 38 to a region below the rearward edge 42 of the top surface 23.

In FIG. 5*a,* club face 22 is seen to have an optional tilt angle θ, relative to vertical, of a few degrees, say less than 5 degrees. Vertical is represented by the dashed line. Such an angle will provide a modest amount of loft while still providing hard contact with the ball.

Figure 6:
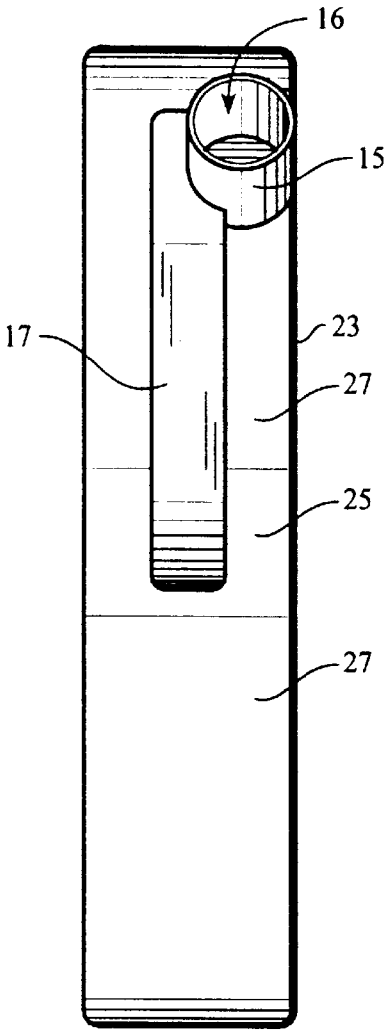
FIG. 6 is a top view of the apparatus of FIG. 1 with the shaft removed.

With reference to the top view of FIG. 6 the top surface 23 may be seen to have a center section 25 which is flat. The side sections 27 slope symmetrically, downwardly away from the center section 25. Hosel 15 angles upwardly from hosel arm 17 and accommodates a shaft in the central aperture 16.

Figure 7:
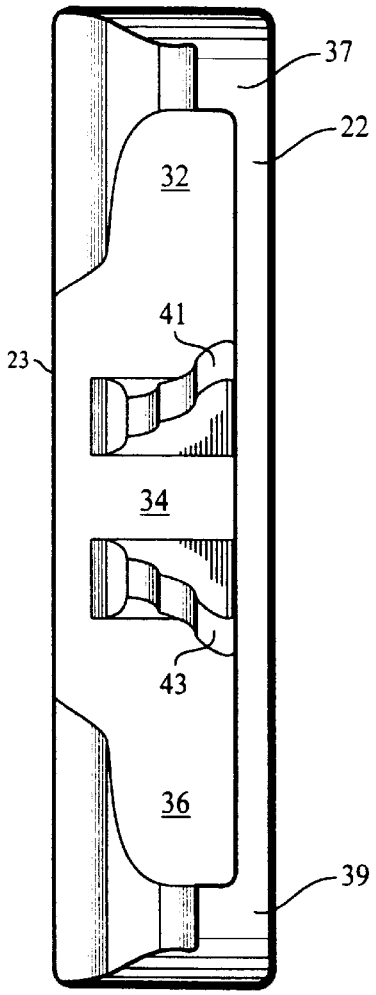
FIG. 7 is a bottom view of the apparatus of FIG. 1.

In FIG. 7, a bottom view, club face 22 may be seen to have uniform thickness between heel region 37 and toe region 39. Ribs 41 and 43 are seen to reinforce club face 22 by solidly backing the central portion of the club face. The mass relieved regions 32, 34 and 36 represent more than 50% of the volume of the block from which the club head is made. The sloping walls of the heel and toe regions provide additional mass relief. Unlike clubs of the prior art, all of the mass which is removed is below the upper surface 23 of the club. The upper surface is kept intact, being a rectangular surface, but regions below the top surface are mass relieved, with a gradient, i.e. more mass is relieved toward the lower surface or sole of the club. This tends to raise the center of gravity of the club with an inverted mass relief profile. As mentioned before, the mass relief is inverted relative to the prior art where mass relief is toward the upper portion of the club head, lowering the center of gravity of the club.

Figure 8:
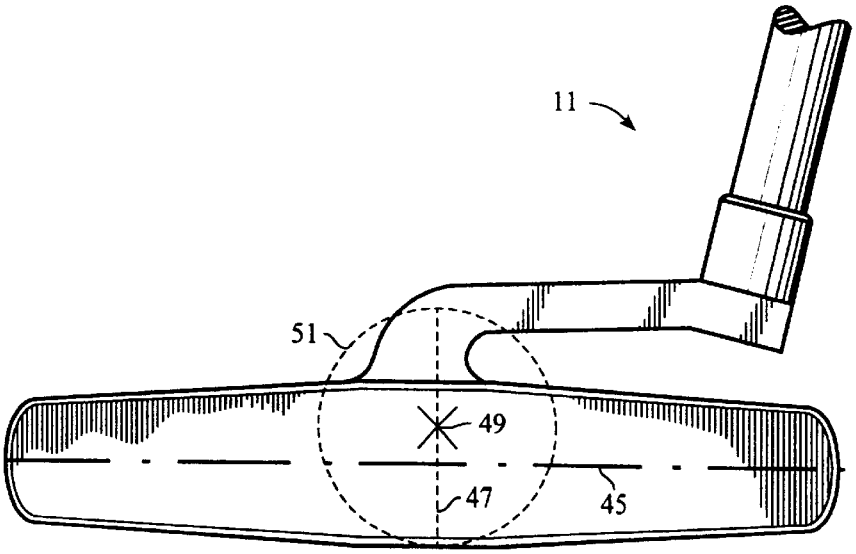
FIG. 8 is a front view of an inverted mass relieved putter of the present invention in a position striking a golf ball.

The purpose for raising the center of gravity of the club may be seen in FIG. 8 where the outline of ball 51 is placed in front of the face of the club. The club face has a lateral axis of symmetry 45 and a vertical axis of symmetry 47. The raised center of gravity of the club is approximated by the position 49, which is intended to correspond to the geometric center of golf ball 51, below the hosel arm junction. This allows club 11 to strike the ball, in a manner similar to a pool cue. In other words, forces transmitted to the ball along a horizontal line, parallel to the ground, which would go through the center of the ball. This imparts to the ball a forward rolling motion, without topspin.

Figure 9:
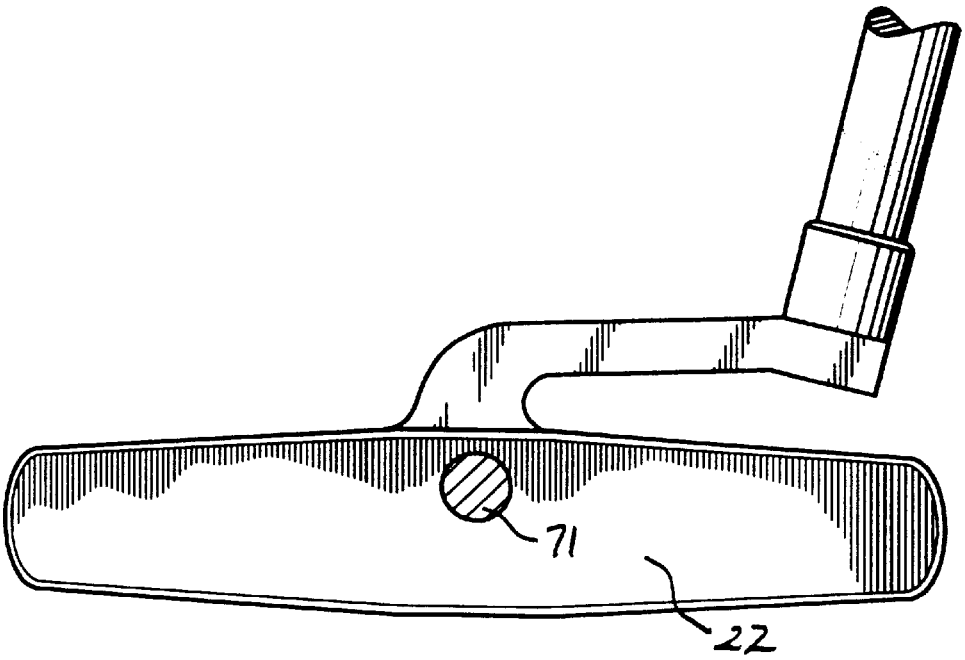
FIG. 9 is a front view of the mass relieved putter of FIG. 1 with a heavy metal plug.
Figure 10:
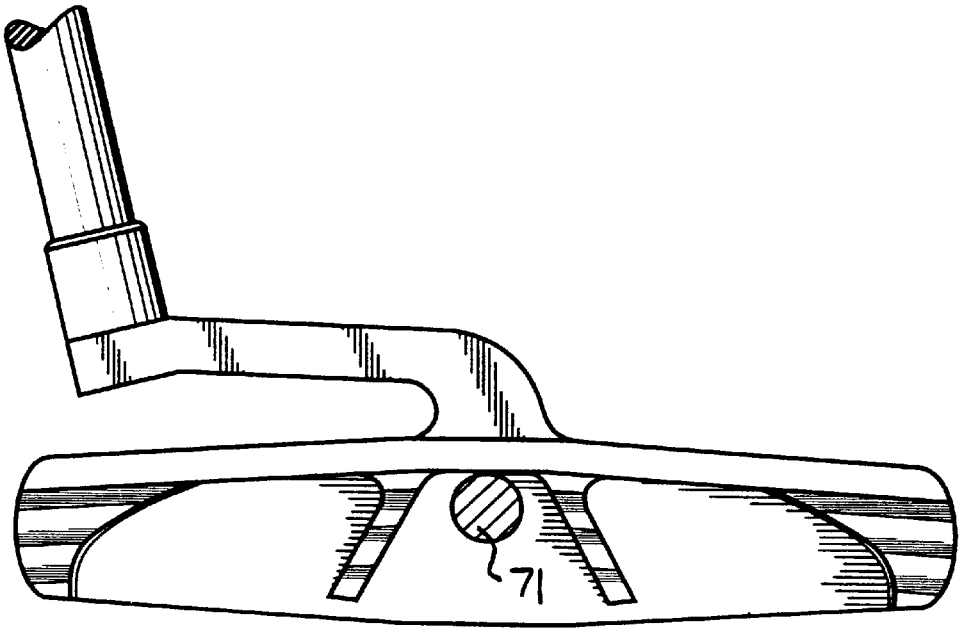
FIG. 10 is a back view of the putter of FIG. 9.

With reference to FIGS. 9 and 10, a mass relieved putter is seen having a round metal plug 71 centered at the raised center of gravity of the club face 22 which is contemplated to be the "sweet spot". While the overall club body is made of a typical club material, such as aluminum or steel, the plug is an ultra heavy metal, such as depleted uranium. An ultra heavy metal is a material having the density of lead or greater. The size of the plug is about one-half inch in diameter but could range in size from one-quarter inch to one inch. The plug is bonded in place with a tight frictional fit in a hole in the club face. The plug is ground flush with the face of the club. By using an ultra heavy metal plug at the sweet spot, greater stiffness is achieved yet the club has no more additional weight than a regular club or putter because of the mass relief. In fact, if no plug is used, the entire mass relieved club head may be made of an ultra heavy metal, such as depleted uranium, to achieve the same effect over the entire club body, rather than the limited zone surrounding the center of gravity. Use of an ultra heavy metal produces a very stiff club face, preferred by certain players, yet the club is no heavier, or not much heavier, than a regular club because of the mass relief.

What is claimed is:

1. A golf club comprising, a shaft terminating in a hosel having a hosel arm, a metal head having a block shape, with a top surface joined to the hosel arm, laterally opposed heel and toe regions, a lower sole surface opposite the top surface, a face transverse to the top surface and a mass relieved region behind the face, below the top surface, relieving the sole entirely except for the lower sole surface and relieving the heel and toe regions partially, leaving ballast regions having greater cross-sectional mass at the heel and toe portions than at regions between the heel and toe portions, whereby the mass relief raises the center of gravity of the head compared to an unrelieved block head shape.

2. The club of claim 1 wherein ribs are disposed behind the face of the head between the ballast regions.

3. The club of claim 2 wherein the ribs taper in thickness from the top surface downwardly, the downward extent of the ribs being short of the sole.

4. The club of claim 3 wherein the extent of taper has a non-uniform gradient, leaving more mass toward the top surface.

5. The club of claim 4 wherein the non-uniform gradient has a stepped characteristic.

6. The club of claim 1 wherein the face has a lateral axis of symmetry.

7. The club of claim 1 wherein the face has a vertical axis of symmetry.

8. The club of claim 7 wherein the hosel arm joins the top surface aligned with the vertical axis of symmetry.

9. The club of claim 7 wherein the hosel arm is connected to the top surface off of the vertical axis of symmetry.

10. The club of claim 1 wherein the face has both lateral and vertical axes of symmetry.

11. The club of claim 9 wherein the center of gravity of the head is on the vertical axis of symmetry above the lateral axis of symmetry.

12. The club of claim 1 wherein the club head includes a plug of ultra heavy metal.

13. The club of claim 12 wherein the ultra heavy metal is depleted uranium.

14. A golf club comprising, a shaft terminating in a hosel having a hosel arm, a metal head having a block shape, with a top surface joined to the hosel arm, laterally opposed heel and toe regions, a lower sole surface opposite the top surface, a face transverse to the top surface, with vertical and lateral axes of symmetry, and a mass relieved region behind the face, below the top surface, relieving the sole entirely except for a region at the underside of the top surface, behind the face, and relieving the heel and toe regions partially, leaving greater cross-sectional mass at the heel and toe portions than at regions between the heel and toe portions, whereby the mass relief raises the center of gravity of the head above the lateral axis of symmetry.

15. The club of claim 14 wherein the club head is made of an ultra heavy metal.

16. The club of claim 14 wherein the club head includes a plug near the center of gravity of the head made of an ultra heavy metal.

17. The club of claim 14 wherein ribs are disposed behind the face of the head between the ballast regions.

18. The club of claim 17 wherein the ribs taper in thickness from the top surface downwardly, the downward extent of the ribs being short of the sole.

19. The club of claim 18 wherein the extent of taper has a non-uniform gradient, leaving more mass toward the top surface.

20. The club of claim 19 wherein the non-uniform gradient has a stepped characteristic.

* * * * *